US005441062A

United States Patent [19]

Nogues

[11] Patent Number: 5,441,062

[45] Date of Patent: Aug. 15, 1995

[54] METHOD AND DEVICE FOR PICKLING THE EDGE PORTIONS OF A SHEET IMMERSED IN A REACTIVE SOLUTION, IN PARTICULAR A HOT ROLLED SHEET

[75] Inventor: Michel Nogues, Triel Sur Seine, France

[73] Assignee: Sollac, Puteaux, France

[21] Appl. No.: 178,794

[22] Filed: Jan. 7, 1994

Related U.S. Application Data

[62] Division of Ser. No. 950,700, Sep. 25, 1992, abandoned.

[30] Foreign Application Priority Data

Oct. 7, 1991 [FR] France ..... 91 12324

[51] Int. Cl.[6] ..... B08B 3/12

[52] U.S. Cl. ..... 134/122 R; 134/184; 310/323

[58] Field of Search ..... 134/1, 15, 64 R, 122 R, 134/184; 68/355; 366/127; 74/155; 310/323, 325

[56] References Cited

U.S. PATENT DOCUMENTS

| | | | |
|---|---|---|---|
| 2,784,119 | 3/1957 | McCown et al. | 134/122 R X |
| 3,072,808 | 1/1963 | Plesset et al. | 366/127 X |
| 3,094,469 | 6/1963 | Strauss et al. | 134/1 X |
| 3,173,034 | 3/1965 | Dickey et al. | 310/325 X |
| 3,575,383 | 4/1971 | Coleman | 134/184 X |
| 3,702,795 | 11/1972 | Wessells | 134/1 X |
| 3,712,833 | 1/1973 | Fichaux | 134/122 R X |
| 3,891,869 | 6/1975 | Scarpa | 310/325 |
| 4,504,760 | 3/1985 | Yamamoto et al. | 310/323 |
| 4,555,302 | 11/1985 | Urbank | 156/637 |
| 4,788,468 | 11/1988 | Izukawa et al. | 310/323 |

FOREIGN PATENT DOCUMENTS

| | | | |
|---|---|---|---|
| 8208510 | 11/1982 | France . | |
| 2103361 | 1/1971 | Germany . | |
| 245465 | 1/1968 | U.S.S.R. | 134/122 R |

OTHER PUBLICATIONS

*Application of Ultrasonic In The Electroplating Industry*, by Dr. T. J. Bulaf, Metal Fishing, Aug. 1987.

Copy of the French Search Report.

*Primary Examiner*—Philip R. Coe

*Attorney, Agent, or Firm*—Sixbey, Friedman, Leedom & Ferguson

[57] ABSTRACT

The device comprises an ultrasonic wave emitter (4) whose lower end portion (5) is immersed in the reactive solution (2) in which a sheet (3) to be pickled is immersed, and this end portion is provided with two emitting plates (6,7) respectively positioned on each side of an edge portion of the sheet (3) with their planar emitting surfaces parallel to the sheet and contained in two antinodal planes. Consequently, the two plates (6,7) vibrate in phase opposition and, if the vibratory amplitude is sufficiently large, these vibrations create a cavitation in the liquid in the space between the surfaces (3a,3b) of the edge portion and the plates (6,7) which considerably accelerates the rate of removal of scale from the edge portion.

4 Claims, 2 Drawing Sheets

METHOD AND DEVICE FOR PICKLING THE EDGE PORTIONS OF A SHEET IMMERSED IN A REACTIVE SOLUTION, IN PARTICULAR A HOT ROLLED SHEET

This is a divisional application of Ser. No. 07/950,700, filed Sep. 25, 1992, and now abandoned.

The present invention relates to the pickling of the edge portions of a metal sheet immersed in a reactive solution, in particular the pickling of hot rolled steel sheets in metallurgical installations prior to their cold rolling.

As is known, the strips of hot rolled steel are covered with a layer of oxides, namely scale, which is a hard, brittle and abrasive material which must be removed before cold rolling. Indeed, as it elongates less than the steel, the scale would become encrusted in the metal and would very substantially reduce its pressing capability. Being abrasive, it would rapidly deteriorate the surface quality of the rolls, the appearance of the sheets would be poor, non-bright, unsuitable for polishing and the various subsequent coatings.

Scale, which is a mixture of three oxides FeO, Fe304 and Fe203, and also chromium oxides in the case of stainless steels, is conventionally pickled by immersion of the steel strips in tanks containing a reactive solution of hot acid, such as sulphuric acid, hydrochloric acid, etc. Consequently, a plurality of tanks are usually employed in order to attain sufficient levels of pickling, the product to be pickled remaining in these tanks for one to several minutes.

For accelerating the pickling process, it has been proposed to generate in the reactive solution in which the product to be pickled is immersed, high frequency vibrations such as ultrasonic vibrations whose action is added to that of the bath to break down the layer of scale. There is then observed a large increase in the pickling rate, the best performances being obtained with very high vibratory powers injected in the solution and consequently capable of producing within the liquid acoustic cavitation phenomena.

Now, the pickling of the edge portions of the product presents a particular problem, since the cooling of the edge portions is more rapid than that of the central zone. Consequently, the oxides formed on the edge portions are different from those of the central zone, which reduces the pickling rate on the edge portions relative to that of the centre of the product, at least in certain pickling lines.

An object of the invention is therefore to improve the pickling rate on the edge portions of the product.

In the method according to the invention, means are employed for emitting ultrasonic waves in the reactive solution in which the sheet to be pickled is immersed, these emitting means having an emitting surface.

According to the invention, the ultrasonic waves are emitted in at least one plane parallel to the edge portion to be pickled and with sufficient power to create a cavitation in the volume of liquid between the edge portion and said plane.

Preferably, the ultrasonic waves are emitted in two antinodal planes parallel to the edge portion and respectively located on each side of the latter.

As an antinodal plane is a plane in which the vibration imparted to the liquid has its maximum amplitude, this means that the plane of one of the ultrasonic wave emitting surfaces must be located at a distance from the plane of the other emitting surface equal to ½ wavelength or a multiple of this value. It is found that, under these conditions, if this vibratory amplitude is sufficiently large, a cavitation is created in the liquid between the emitting plate and the surface of the edge portion.

According to the invention, the device for carrying out this method comprises at least one plate element having a planar emission surface provided for being placed above an edge portion of the sheet and parallel to the latter.

According to a preferred embodiment of the invention, the device comprises two emitting plates respectively placed on each side of an edge portion of the sheet with their emitting surfaces contained in two antinodal planes.

As in the foregoing embodiment, if the amplitude of the vibrations, i.e. if the emission power of the pavilion elements is sufficient, and if the frequency range is suitably chosen, it is possible to create in the liquid a cavitation between the two plates which considerably accelerates the pickling of the edge portions.

Further features and advantages of the invention will be apparent from the following description with reference to the accompanying drawings which illustrate an embodiment given as a non-limitative example.

Figure 2:
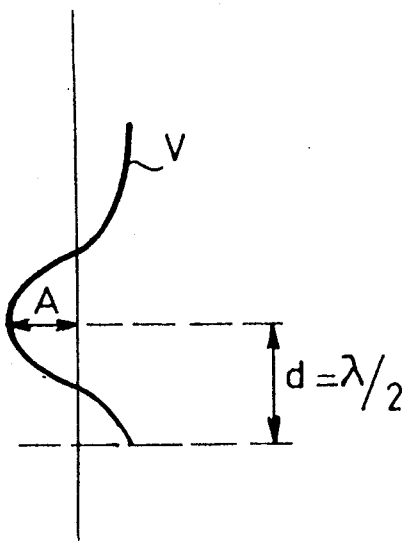
FIG. 2 is a diagram showing the variation in the amplitude of the vibration imparted to the emitting pavilion elements and transmitted to the liquid, and in particular the antinodal planes in which the emitting plates are placed.
Figure 1:
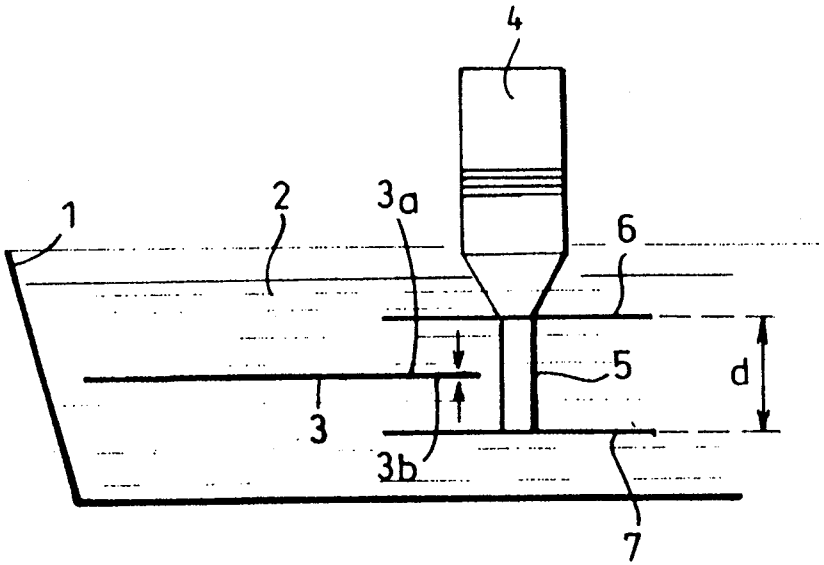
FIG. 1 is a simplified elevational view of an embodiment of the device for pickling the edge portions of a sheet according to the invention.
Figure 4A:
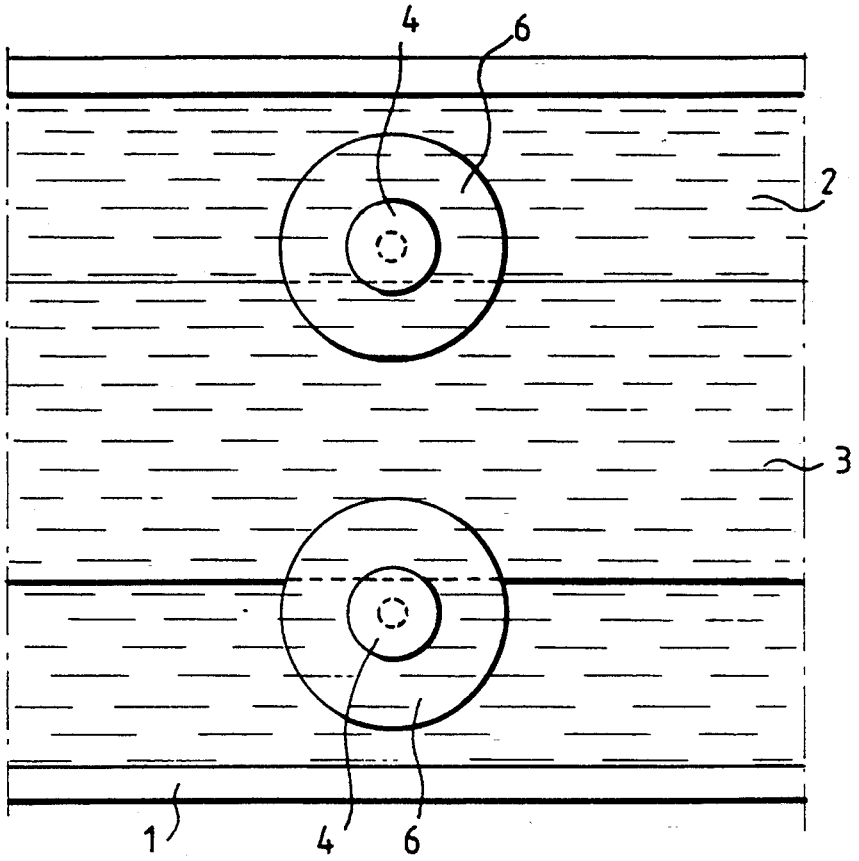
FIGS. 4A and 4B are plan views of the embodiment of the device illustrated in FIG. 1 equipped with circular and semicircular emitting plates, respectively.
Figure 4B:
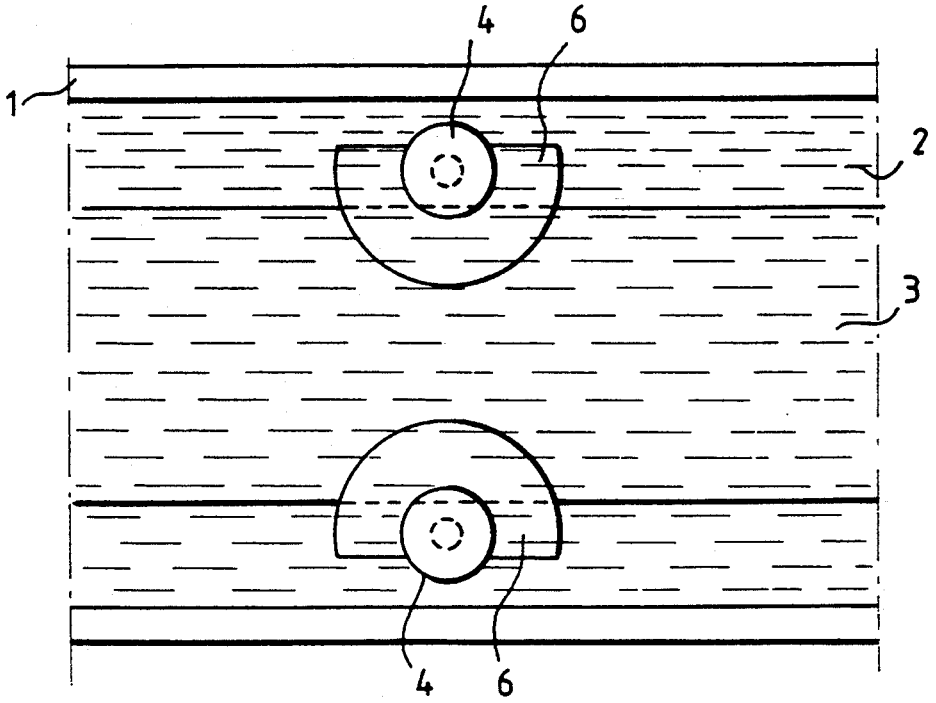

There is shown in FIG. 1 and FIGS. 4A and 4B a tank 1 containing a reactive solution 2, such as hydrochloric acid, in which a travelling sheet 3 is immersed in the known manner for the purpose of removing its layer of scale.

The device for pickling the surfaces 3*a*, 3*b* of an edge portion of the sheet 3 comprises an ultrasonic wave emitter such as a piezoelectric emitter 4 whose lower end, immersed in the solution 2, is a sonotrode 5 on which are fixed two emitting plates 6, 7 respectively on each side of the edge portion of the sheet 3 and parallel to the latter. The two plates 6, 7 are therefore immersed in the solution 2, the upper plate 6 being disposed above the surface 3*a* of the edge portion and the lower plate 7 below the lower surface 3*b* of the edge portion so that the latter is partly overlapped by the planar surfaces of the plates 6, 7. The distance d between the plates 6 and 7 is such that their emitting surfaces are located in two antinodal planes spaced apart from each other in the illustrated embodiment ½ wavelength $d=\lambda/2$ of the vibration V imparted to the solution 2.

This distance d may also be a multiple of the ½ wavelength $\lambda/2$, i.e. $d=n\ \lambda/2$.

Under these conditions, the two planar emitting surfaces of the plates 6, 7 vibrate in phase opposition and, if the maximum amplitude A of the vibrations is large enough, a cavitation is obtained in the part of the liquid 2 between the two plates 6, 7 and facing the surfaces 3*a*, 3*b* of the edge portion. The pickling of the latter is in this way considerably accelerated.

The sonotrode and the plates 6, 7 may be made for example from titanium so as to be little sensitive to corrosion by the solution 2. To obtain a cavitation field in the liquid 2 within the space between the plates 6, 7 and the edge portion to be pickled, tests have shown that the ultrasonic waves emitted must have a frequency between about 10 and 50 kHz and that their emission power must be at least 400 Watts per square meter of the plate. The distance d may be for example 15 cm for a frequency of around 20 kHz.

In an advantageous embodiment, the plates 6, 7 are discs having a circular contour as shown in FIG. 4A. This contour has the advantage of homogenizing the reflections of the waves on the edge portions of the plate and therefore facilitates putting the disc constituting the plate into resonance, which in turn can produce cavitation in the liquid 2.

Figure 3:
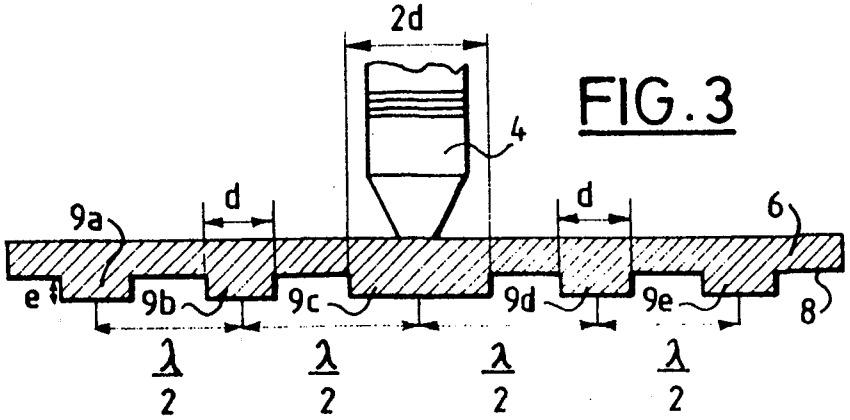
FIG. 3 is a sectional view of a particular configuration of an emitting plate of the device according to the invention.

In a modification, shown in FIG. 3, there may also be provided on the surface or surfaces 8 of the plates 6, 7 facing toward the product, extra thicknesses 9*a*, 9*b*, 9*c*, 9*d*, 9*e* which have a width d and are concentric with the circumference of the plate and are evenly spaced apart with a pitch equal to a $\frac{1}{2}$ wavelength $\lambda/2$. This configuration substantially increases the vibratory efficiency. If these plates have a shape different from that of a circle or semi-circle, these extra thicknesses must be arranged to be parallel to the edge portions of the plates.

The plates 6, 7 may optionally be constructed in the form of semi-circular discs, as shown in FIG. 4B. It will be understood that a pickling device such as that described hereinbefore is provided for each of the two edge portions of a sheet.

What is claimed is:

1. Device for pickling edge portions of a metal sheet immersed in a reactive solution by creating ultrasonically induced cavitation in the reactive solution located in the vicinity of said edge portions, said device comprising means for ultrasonically generating cavitation in reactive solution surrounding the edge portions of said metal sheet such that said edge portions are contacted by cavitated solution, said means including two ultrasonically emitting plates respectively placed on each side of an edge portion of said sheet for emitting ultrasonic waves having a wavelength of $\lambda$, each of which includes a planar emitting surface disposed above its respective edge portion of said sheet and parallel to said sheet with said emitting surfaces thereof contained in two antinodal planes such that cavitation is produced in the volume of said solution between the plane of said surface of said plate and said edge portion of said sheet.

2. Device accordingly to claim 1, wherein said plates have a circular contour.

3. Device accordingly to claim 1, wherein said plates have a semi-circular contour.

4. Device according to claim 1, wherein said plates have on a surface thereof facing toward said sheet extra thicknesses arranged to be parallel to the edge of said plate and spaced apart at a pitch equal to $\lambda$.

* * * * *